US009206580B2

(12) United States Patent
Oliver et al.

(10) Patent No.: US 9,206,580 B2
(45) Date of Patent: Dec. 8, 2015

(54) SIDE WALL SUPPORT PIER AND METHOD FOR FOUNDATION OF MANUFACTURED BUILDING

(76) Inventors: Scott E. Oliver, Linden, TN (US); Daniel L. Oliver, Linden, TN (US); John A. Oliver, Linden, TN (US)

( * ) Notice: Subject to any disclaimer, the term of this patent is extended or adjusted under 35 U.S.C. 154(b) by 364 days.

(21) Appl. No.: 13/154,289

(22) Filed: Jun. 6, 2011

(65) Prior Publication Data

US 2012/0304555 A1 Dec. 6, 2012

(51) Int. Cl.
*E02D 27/08* (2006.01)
*E02D 27/01* (2006.01)

(52) U.S. Cl.
CPC ..... *E02D 27/01* (2013.01)

(58) Field of Classification Search
CPC ..... E04B 1/34352; E04B 1/34336; E04B 1/34347; E02D 27/01; E02D 27/02; E02D 27/48; E04G 23/0218
USPC ..... 52/292, 299, 169.9, 741.15, 157, 693
See application file for complete search history.

(56) References Cited

U.S. PATENT DOCUMENTS

| | | | | | |
|---|---|---|---|---|---|
| 1,871,131 | A | * | 8/1932 | Rawson | 52/291 |
| 2,345,253 | A | * | 3/1944 | Funk | 52/120 |
| 2,960,832 | A | * | 11/1960 | Hayward | 405/227 |
| 3,606,231 | A | * | 9/1971 | Kilborn | 48/354.3 |
| 3,750,349 | A | * | 8/1973 | Deike | 52/23 |
| 3,751,866 | A | * | 8/1973 | Renchen | 52/149 |
| 3,793,787 | A | * | 2/1974 | Shidaker et al. | 52/163 |
| 4,068,427 | A | * | 1/1978 | Camardo | 52/127.2 |
| 4,348,843 | A | | 9/1982 | Cairns | |
| 4,417,426 | A | * | 11/1983 | Meng | 52/126.7 |
| 4,546,581 | A | * | 10/1985 | Gustafson | 52/169.9 |
| 4,682,460 | A | * | 7/1987 | Reetz | 52/632 |
| 4,863,137 | A | | 9/1989 | Cockman | |
| 4,899,497 | A | | 2/1990 | Madl | |
| 4,923,165 | A | | 5/1990 | Cockman | |
| 4,937,989 | A | * | 7/1990 | Miyares et al. | 52/126.7 |
| 5,152,108 | A | * | 10/1992 | Madl, Jr. | 52/126.1 |
| 5,359,821 | A | * | 11/1994 | Merriman | 52/169.9 |
| 6,230,448 | B1 | | 5/2001 | Oliver | |
| 6,243,996 | B1 | * | 6/2001 | Oliver et al. | 52/126.1 |
| 6,256,940 | B1 | | 7/2001 | MacKarvich | |

(Continued)

FOREIGN PATENT DOCUMENTS

GB 2201702 A * 9/1988 ..... E04H 12/22

OTHER PUBLICATIONS

Oliver Technologies, Inc.; Manufactured Housing Foundation Systems, A Division of Oliver Technologies, Inc.; Swivel Frame Tie, 467 Swan Ave., Hohenwald, TN 38462; Dec. 4, 2002.

(Continued)

*Primary Examiner* — Christine T Cajilig
(74) *Attorney, Agent, or Firm* — Baker Donelson

(57) ABSTRACT

An apparatus for supporting a lateral portion of a manufactured building having a support beam, comprising a ground member for being received on a ground surface and a joist bracket attached to at least one joist in a lateral portion of the manufactured building. A pivotably attached joist tube disposed in a first position between the ground member and the joist bracket is longitudinally movable to a second position for bearing forcibly therebetween and thereby supporting the lateral portion of the manufactured building. A method of supporting a lateral portion of a manufactured building having a support beam is disclosed.

31 Claims, 10 Drawing Sheets

(56) References Cited

U.S. PATENT DOCUMENTS

| | | | | |
|---|---|---|---|---|
| 6,272,798 | B1 | 8/2001 | Cockman | |
| 6,334,279 | B1 | 1/2002 | Oliver | |
| 6,505,447 | B1 | 1/2003 | Oliver | |
| 6,591,564 | B2 * | 7/2003 | Cusimano | 52/274 |
| 6,634,150 | B1 | 10/2003 | Oliver | |
| 6,634,615 | B1 * | 10/2003 | Bick et al. | 248/499 |
| 7,526,899 | B1 | 5/2009 | Oliver | |
| 2001/0023563 | A1 * | 9/2001 | Phillips | 52/292 |
| 2002/0170253 | A1 * | 11/2002 | MacKarvich | 52/292 |
| 2003/0066251 | A1 * | 4/2003 | Cusimano | 52/169.9 |
| 2003/0140578 | A1 * | 7/2003 | Moreno, Jr. | 52/169.1 |
| 2003/0213197 | A1 * | 11/2003 | Oliver et al. | 52/299 |
| 2005/0188627 | A1 | 9/2005 | Alberts | |
| 2009/0038240 | A1 * | 2/2009 | Leonard | 52/169.9 |
| 2011/0036025 | A1 * | 2/2011 | Boulay | 52/157 |
| 2011/0041437 | A1 | 2/2011 | Moreno | |
| 2012/0011781 | A1 * | 1/2012 | Moreno et al. | 52/169.9 |
| 2012/0066992 | A1 | 3/2012 | Moreno | |

OTHER PUBLICATIONS

Oliver Technologies, Inc.; Installation Instructions, Model #OTLT, Longitudinal Beam Connector, 467 Swan Ave., Hohenwald, TN 38462; Aug. 13, 2003.

Oliver Technologies, Inc.; Installation Instructions Galvanized Strapping, p. 15; 467 Swan Ave., Hohenwald, TN 38462; Nov. 2002.

Oliver Technologies, Inc.; Wind Zone Map, p. 16: 467 Swan Ave., Hohenwald, TN 38462; Nov. 2002.

Oliver Technologies, Inc.; Specifications, Oliver Technologies, Inc.—Adjustable Outrigger, p. 25; 467 Swan Ave., Hohenwald, TN 38462; Nov. 2002.

Oliver Technologies, Inc.; Specifications, Oliver Technologies, Inc.—Anchors and Components; pp. 26-28; 467 Swan Ave., Hohenwald, TN 38462; Nov. 2002.

Oliver Technologies, Inc.; Installation Instructions Galvanized Strapping, p. 9, 467 Swan Ave., Hohenwald, TN 38462; Jun. 2004.

Oliver Technologies, Inc.; Ground Anchor Installation Instructions, p. 9, 467 Swan Ave., Hohenwald, TN 38462; Nov. 2002.

OTI, Installation Instructions OTI Auger Anchor, p. 10, 467 Swan Ave., Hohenwald, TN 38462; Nov. 2002.

OTI, "Quick Anchor Installation Instructions Model #OTCAP1, OTI Anchor Model#'s OT3044BP and OT3646BP", p. 11, 467 Swan Ave., Hohenwald, TN 38462; Nov. 2002.

OTI, "Ground Anchor Installation Instructions", p. 12, 467 Swan Ave., Hohenwald, TN 38462; Nov. 2002.

OTI, "Longitudinal Frame Connections OTQC", p. 13, 467 Swan Ave., Hohenwald, TN 38462; Nov. 2002.

OTI, "I-Beam Frame Connections Swivel Connector (Part# 2001)", p. 14; 476 Swan Ave., Hohenwald, TN 38462; Nov. 2002.

Oliver, Scott, Anchor Pier for Manufactured Building, U.S. Appl. No. 12/868,160, filed Aug. 25, 2010.

* cited by examiner

SIDE WALL SUPPORT PIER AND METHOD FOR FOUNDATION OF MANUFACTURED BUILDING

TECHNICAL FIELD

The present invention relates to foundations for manufactured buildings. More particularly, the present invention relates to apparatus and methods for a foundational support of a lateral portion of a manufactured building.

BACKGROUND OF THE INVENTION

Manufactured buildings, such as manufactured or mobile homes and offices, are manufactured remote from an installation site and moved on wheels to the installation site. The manufactured building typically includes one or more long, longitudinal support I-beams underneath the building. A plurality of spaced-apart floor joists extend transverse to a longitudinal axis of the support beam. Adjacent floor joists define gaps. The gaps on opposing sides of the manufactured building are closed by perimeter rim joists that attach to the ends of the floor joists. A subfloor attaches to the floor joists. The side walls of the manufactured building define openings for door ways and windows or for other load-imposing features such as chimneys or fireplaces.

During typical installation of a manufactured building at a site, a plurality of piers placed between a ground surface and the support beam support the building on the site. The piers sit on or attach to footings such as metal plates or pans, plastic plates, or concrete pads placed or poured on-site during installation. The number, and positioning, of piers is specified by the manufacturer of the manufactured building or by an authority having jurisdiction for such specifications.

Different types of piers are known. One type of pier uses stacks of cement blocks that sit on footings and transfer load from the support beam. Other piers use metal tubular members that connect between a ground pan and the support beam. Additionally, some foundation systems for manufactured buildings also resist lateral and longitudinal wind and/or seismic forces on the building. These foundation systems typically use a ground pan and an elongated strut connected at a lower end to the ground pan and at the upper end to a support beam of the manufactured building. The elongated strut can be oriented parallel to a longitudinal axis of the support beam or extend laterally from underneath one support beam to connect to the adjacent support beam of the manufactured buildings, or both. Such foundations provide resistance to wind and/or seismic forces in the lateral and longitudinal directions.

Often the support beam is positioned inwardly of a lateral perimeter portion of the manufactured building. The plurality of floor joists extends outwardly as cantilevers laterally of the I-beam. This structure disposes a portion of the manufactured building lateral of the support beams. Piers are necessary for supporting perimeter portions of the manufactured buildings. Openings in the side walls for windows and doorways require a support pier proximate the opening. Generally, an opening of 48 inches or more in a side wall of a manufactured building requires pier supports. For example, door openings require two support piers on the opposing sides of the opening at the perimeter of the building. Chimneys and fireplaces or other load-bearing objects (such as water beds) may require additional pier support on the perimeter of the building. Roof loads (for example, snow loading) may require use of additional piers on the perimeter. Pier installation requires time and labor.

Accordingly, there is a need for an improved pier to support portions of a manufactured building lateral of the support beam and proximate an opening in a side wall of a manufactured building. It is to such that the present invention is directed.

BRIEF SUMMARY OF THE INVENTION

The present invention meets the need in the art by providing a support apparatus for supporting a lateral portion of a manufactured building having a support beam, comprising a ground member for being received on a ground surface beneath a manufactured building having a portion thereof lateral of a support beam and a joist bracket attached to at least one joist within the lateral portion of the manufactured building. A joist tube is disposed between the ground pan and the joist bracket. The joist tube bears against the joist bracket and the ground member for transferring a load from the lateral portion of the manufactured building to the ground and thereby supporting the lateral portion of the manufactured building.

In another aspect, the present invention provides a method for supporting a lateral portion of a manufactured building having a support beam, comprising the steps of:

(a) positioning a ground member on a ground surface below a lateral portion of a manufactured building;

(b) attaching a joist bracket to at least one joist within the lateral portion of the manufactured building; and (c) disposing a joist tube in bearing contact between the ground member and the joist bracket, whereby the joist tube bears forcibly against the joist bracket to support the lateral portion of the manufactured building.

Objects, advantages, and features of the present invention will be apparent upon a reading of the detailed description together with observing the drawings and reading the appended claims.

DETAILED DESCRIPTION

Figure 1:
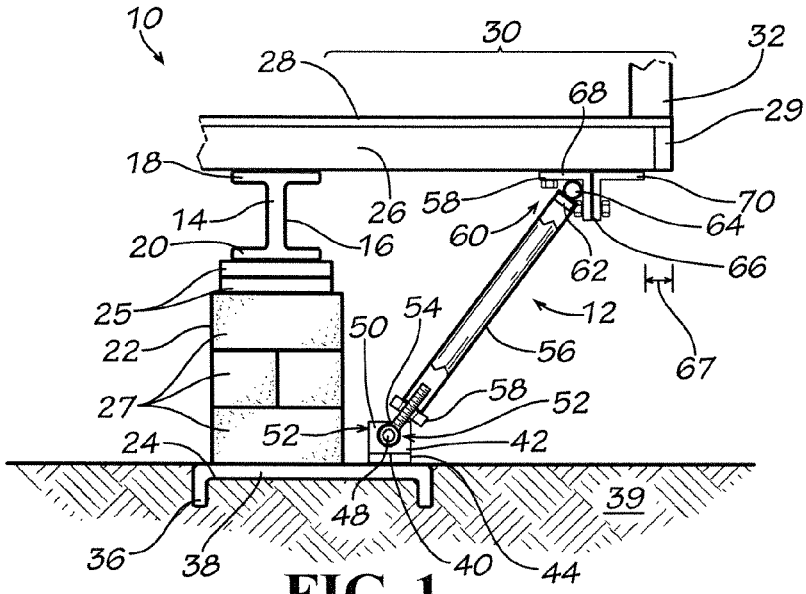
FIG. 1 illustrates in side elevational view a manufactured building with an embodiment of a support pier according to the present invention supporting a lateral portion of the manufactured building proximate an opening in a side wall.

With reference to the drawings, in which like elements have like identifiers, FIG. 1 illustrates a side elevational view of a portion of a manufactured building 10 having an embodiment of a support pier 12 supporting a portion of the manufactured building lateral of a long, longitudinal support beam 14. The support beam 14 conventionally is an I-beam having a central web 16 with spaced-apart upper and lower forward and rearward laterally extending opposing flanges 18, 20. The support beam 14 sits on a cement block pier 22 positioned on a ground foundation member or support that in the illustrated embodiment is a metal ground pan 24. Wooden spacer boards 25 are depicted between the support beam 14 and an upper surface of the stack of cement blocks 27 in the pier 22. Typically, the support beam 14 is spaced inwardly of the side wall (for example, typically 2-3 feet or more). This disposes the ground pan 24 away from the side wall and side skirting where water may collect and saturate the ground. Saturated ground may cause ground heave or movement that occurs due to freezing and thawing.

The support beam 12 underneath the manufactured building supports the plurality of spaced-apart floor joists 26 disposed transverse to a longitudinal axis of the support beam 12. A perimeter rim joist 29 attaches outwardly of the ends of the floor joists 26. The joists 26 support a floor 28 of the manufactured building 10. A portion 30 of the manufactured building extends laterally of the support beam 14.

Figure 2:
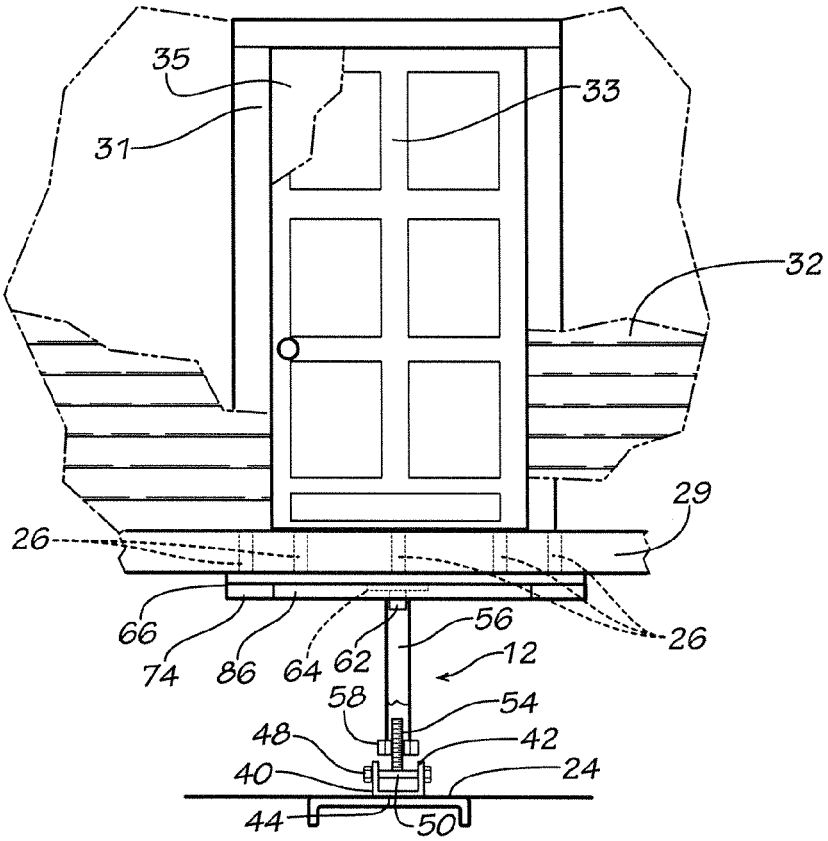
FIG. 2 illustrates in detailed front elevational view the support pier illustrated in FIG. 1 supporting a lateral portion of the manufactured building proximate an opening for a door in a side wall.

As best illustrated in FIG. 2, portions of a side wall 32 of the manufactured building 10 define openings for windows (not illustrated) and for doors 33. Edges generally 31 of the side wall structure define the opening generally 35. An embodiment of the support pier 12 supports the lateral portion 30 of the manufactured building proximate the opening. With continuing reference to FIGS. 1 and 2, the support pier 12 includes the metal ground pan 24. The ground pan 24 has a planar base and at least a pair of opposing sides 38 or insertion perimeter members that extend from respective perimeter edges in a first direction substantially perpendicular to the base for being embedded in the ground. In the illustrated embodiment, the ground pan 24 includes a leg 36 at each of the corners of the ground pan extending from adjacent insertion perimeters 38. The insertion perimeters 38 define side walls that extend from perimeter edges into the ground 39 below the manufactured building at a site. The legs 36 extend downwardly from a top surface of the ground pan to a distal extent a first distance that is greater than a second distance of a distal extent of the insertion perimeter 38. The ground pan 24 is made of strong material such as of steel. It is to be appreciated that as an alternative, ground pans or plates having stakes or spikes that extend into the ground may be gainfully used.

A U-shaped connector 40 has a base 44 and two opposing side walls 42 or upstanding legs extending from the base 44. The connector 40 attaches to the ground pan 24. The U-shaped connector 40 in the illustrated embodiment is made from a 3/16 inch G-60 galvanized stamped coil stock material. The base 44 defines at least one opening for a fastener to extend though an aligned opening in the ground pan 24 to rigidly attach the connector to the ground pan. The side walls 42 define aligned openings for receiving a bolt 48 that is secured with a nut (not illustrated). The bolt 48 extends through the aligned openings in the side walls 42 and through an open-ended tube 50 of a T-bolt 52. The T-bolt 52 includes the tube 50 and a threaded member 54. The threaded member 54 welds to the tube 50. In the illustrated embodiment, the tube 50 is a 12 gauge 1 inch×1 and 5/8 inch steel tube. The threaded member 54 is a 3/4 inch×6 inch metal rod.

Figure 4:
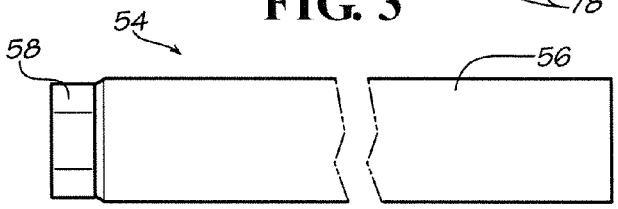
FIG. 4 illustrates in side view a joist tube used with the support pier illustrated in FIG. 1.

A joist tube 56 connects to the threaded member 54. As best illustrated in FIG. 4, the joist tube 56 is an elongated open-ended tube. The joist tube 56 in the illustrated embodiment is a 12 gauge, 1/14 diameter by 60 inch long steel tube. In the illustrated embodiment, a threaded nut 58 is positioned at a first end of the joist tube 56. The threaded nut 58 threadably connects to the member 54, as discussed below. In the illustrated embodiment, the nut 58 welds to the end of the joist tube 56.

With continuing reference to FIG. 1, a distal end of the joist tube 56 receives a T-cap 60. The T-cap 60 has base member 62 sized to be received on or in the distal end of the joist tube 56. In the illustrated embodiment, the base member 62 is a tube sized for being received within the joist tube 56. A bearing member 64 welds to the base member 62. The bearing member 64 is transverse to the base member 62. In the illustrated embodiment the bearing member 64 is a 0.6875 inch diameter solid steel rod of A36M steel.

Figure 3:
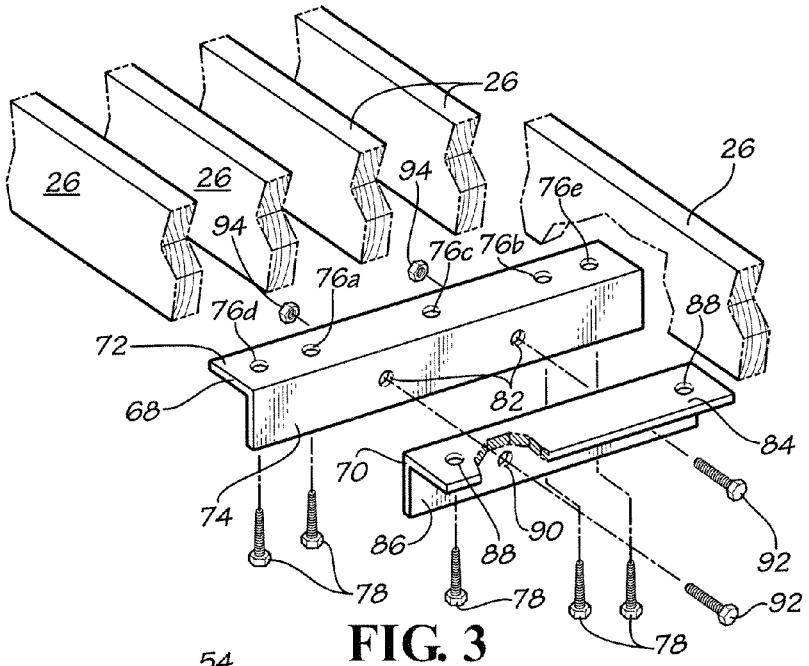
FIG. 3 illustrates in exploded perspective view a joist bracket of the support pier, which attaches to the spaced-apart floor joists inwardly of a perimeter rim joist.

A joist bracket 66 attaches to at least one of the joists to communicate loading from the manufactured building through the joist tube 56 to the ground. In the embodiment illustrated in FIG. 1, the opening 35 is defined in a side wall perpendicular to the longitudinal axis of the floor joists 26. A first embodiment of the joist bracket 66 is disposed transverse to the floor joists 26 and spaced-inwardly a predetermined distance 67 from an outer face of the rim joist 29. The set-back 67 provides space outward therefrom for installing side skirts (not illustrated) in alignment with the side wall of the manufactured building. The side skirts cover openings or gaps between the bottom of the building and the ground. The joist bracket 66 spans a plurality of the floor joists 26 to distribute the loading of the manufactured building. The joist bracket 66 attaches to a plurality of the spaced-apart floor joists 26. The joist bracket 66 in the first embodiment comprises a first angle member 68 and a second angle member 70. As best illustrated in FIG. 3, the first angle member 68 includes a leg 72 that contacts the joists 26 and a depending back 74. The leg 72 defines a plurality of openings 76*a-e* for receiving fasteners 78 in selected ones of the openings to secure the joist bracket 66 to the joists 26. In the illustrated embodiment, the fasteners are threaded lag screws but other fasteners may be used.

In the illustrated embodiment, the first angle member 68 is 48 inches long. Two openings 76*a* and 76*b* are spaced 15¾ inches from a central opening 76*c* for joists on 16 inch centers. Two openings 76*d* and 76*e* are spaced 7½ inches from the respective adjacent opening 76*a*, 76*b* to accommodate joists on 24 inch centers. The depending back 74 defines a pair of openings 82 spaced 16 inches apart and 16 inches from the respective end of the angle member 68.

The second angle member 70 includes a leg 84 that contacts the joists and a depending back 86. The angle member 70 is 38 inches long and the leg 84 defines two openings 88. In the illustrated embodiment, these openings are spaced 3 inches from the respective distal end and 32 inches apart. Fasteners 78 may be used to secure the second angle member 70 to the joists 26. The depending back 86 defines a pair of openings 90 spaced 16 inches apart in alignment with the openings 82 in the first angle member 68. Bolts 92 extend through the aligned openings 82, 90 and receive nuts 94 to connect the first and second angle members 68, 70 rigidly together.

Figure 5:
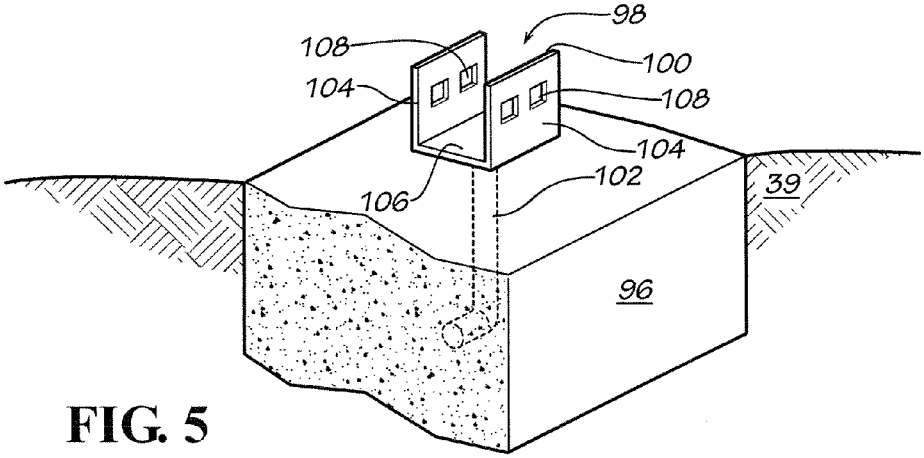
FIG. 5 illustrates in perspective view an alternate embodiment of a ground support for the support pier of the present invention.

FIG. 5 illustrates an alternate embodiment in which the support pier 12 uses a poured concrete pad 96 that receives an anchor head 98 having a U-shaped head 100 and a J-member 102. The J-member 102 is embedded into the poured concrete that cures to rigidly secure the anchor head 98 to the concrete pad 96. The U-shaped head 100 includes opposed side walls 104 and base 106. The side walls 104 define aligned openings 108 for receiving the bolt 48 and T-bolt 52 for connecting to the joist tube 56, as discussed below.

Figure 6:
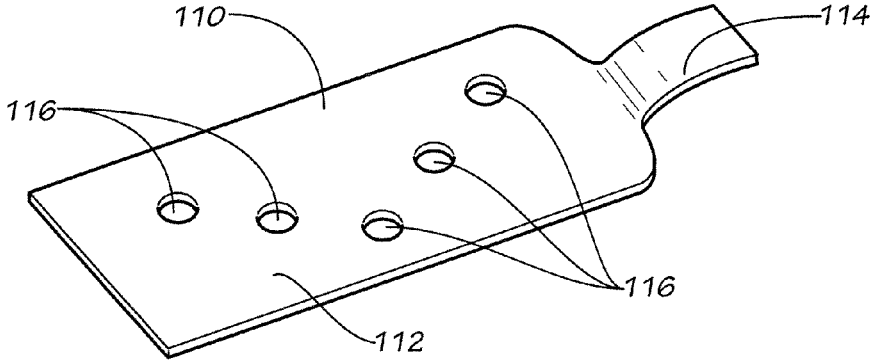
FIG. 6 illustrates in perspective view an alternate embodiment of a joist bracket for use with embodiments of the support pier.

FIG. 6 illustrates in perspective view an alternate embodiment of a joist bracket 110 for use with embodiments of the support pier 12. The joist bracket 110 is a plate having a base portion 112 and a neck portion 114. The plate bends between the base portion 112 and the neck portion 114. The bend positions the neck portion 114 at an approximate 15 degree angle relative to the base portion 112. A plurality of holes 116 are defined in the base portion 112 for receiving fasteners to secure the joist bracket 110 to a joist 26 as discussed below.

Figure 7:
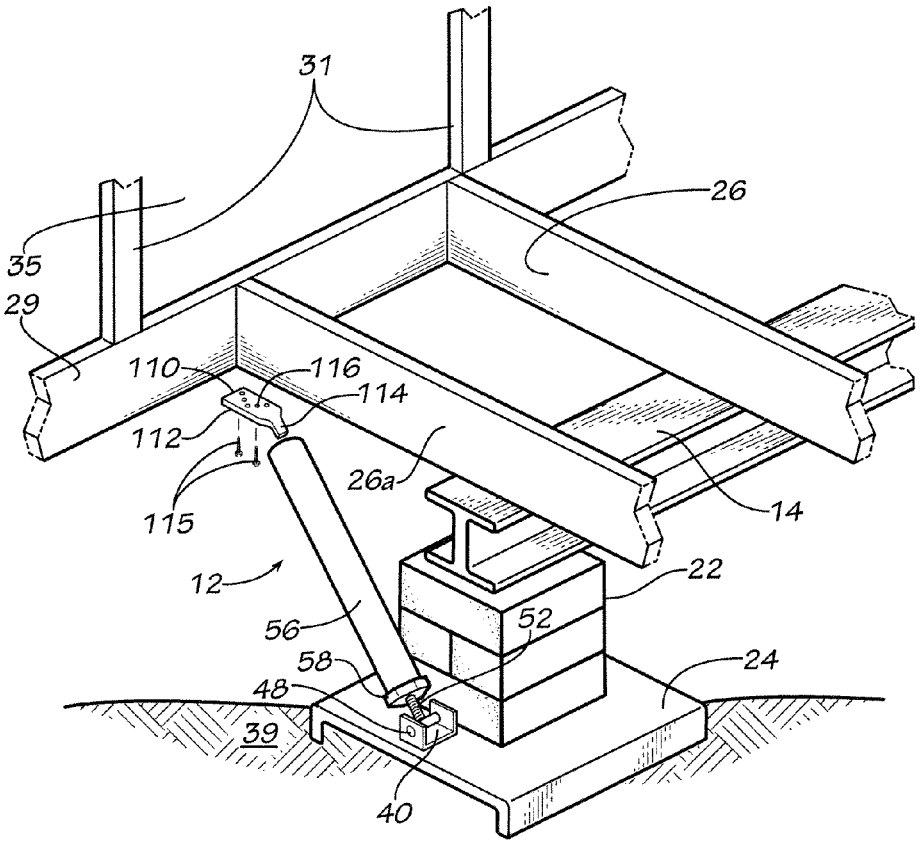
FIG. 7 illustrates in perspective exploded view the support pier and the joist bracket shown in FIG. 6 installed for supporting a portion of a manufactured building where an opening in a side wall is transverse to the floor joists of the manufactured building.

FIG. 7 illustrates in perspective exploded view the support pier 12 using the joist bracket 110 shown in FIG. 6, in order to support a portion of a manufactured building 12 where an opening in a side wall is transverse to the floor joists 26 (or parallel to the longitudinal axis of the support beam 14) of the manufactured building. The joist bracket 110 is shown exploded from the selected joist 26*a* medial the opening 35 in the side wall (not illustrated). Fasteners 115 extend through the openings 116 and into the joist 26 to secure the joist bracket 110 to the joist. The joist bracket 110 is disposed with the neck portion 114 angling downwardly from the manufactured building. The joist bracket 110 installs with a set-back (approximately 10 inches) from an outside face of the rim joist 29. The ground pan 24 seats below the support beam 14 and in-line with the joist 26*a*. The connector 40 attaches to the ground pan 24, and with the T-bolt 52, connects to the joist tube 56. The necked portion 114 seats in the open distal end of the joist tube 56. The joist tube 56 is moved as discussed below to bear forcibly against the joist bracket 110.

Figure 8:
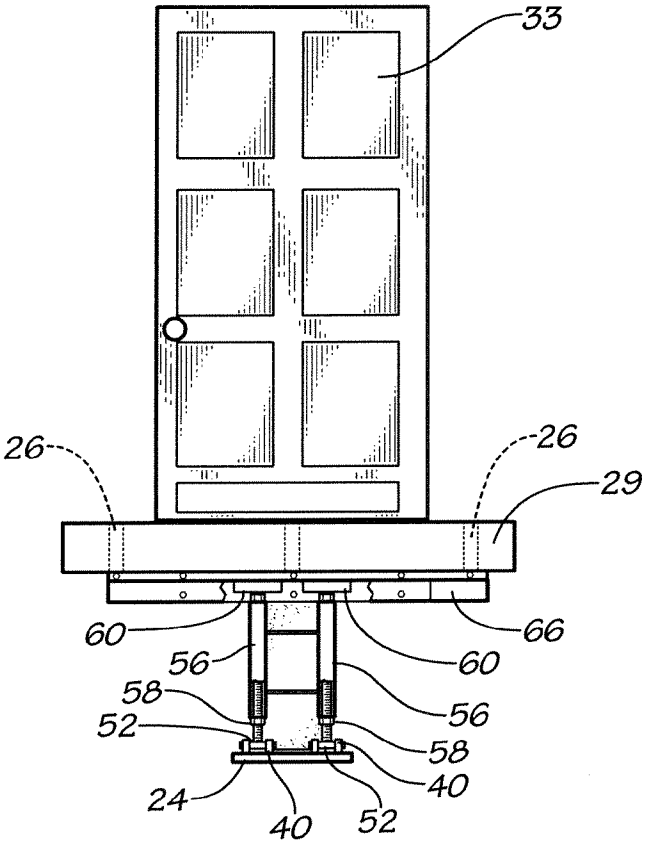
FIG. 8 illustrates in side elevational view a pair of the support piers for supporting a lateral portion of a manufactured building.

FIG. 8 illustrates in side elevational view a pair of the support piers 12 for supporting a lateral portion of a manufactured building 10. In this illustrated application, each the joist tubes 56 attaches to a separate spaced-apart connector 40 and bears against an elongated joist connector 66. The joist connector 66 spans a plurality of the joists 26 for distributing loading to the ground through the joist tubes 56 and the ground foundation member. An alternate embodiment (not illustrated) uses separate ones of the joist bracket 66 that are sufficiently long so that the T-cap 60 extending from the joist tubes 56 bears against a respective joist connector 66. The joist brackets 66 distribute the loading on the side wall through the joist tubes 56 and ground pan to the ground.

Figure 9:
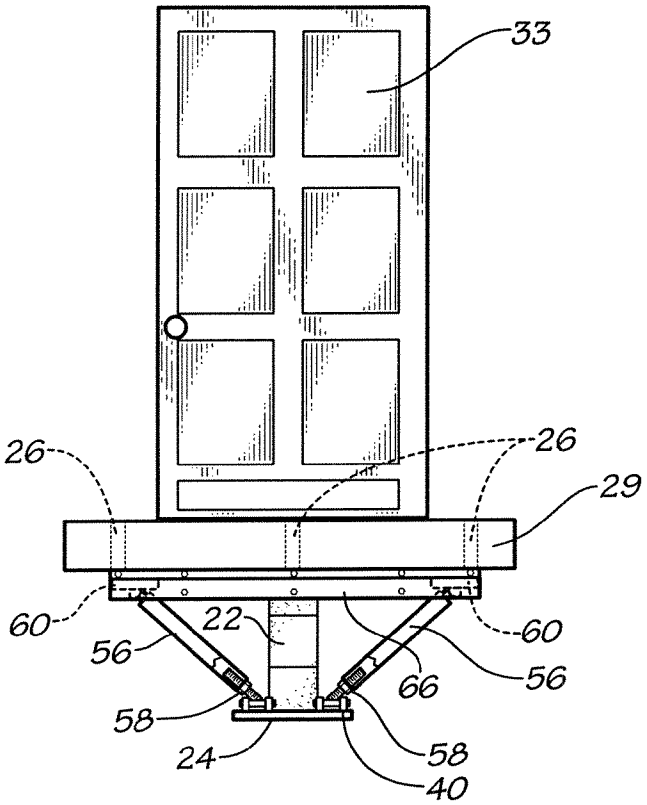
FIG. 9 illustrates in side elevational view a pair of the support piers for supporting a lateral portion of a manufactured building.

FIG. 9 illustrates in side elevational view a pair of the support piers 12 for supporting a lateral portion of a manufactured building 10. In this illustrated application, each the joist tubes 56 attaches to a separate spaced-apart connector 40 and bears through separate T-caps 60 against the joist bracket 66. The connectors 40 are disposed at an angle so that the joist tubes 56 are oriented at an angle towards the edge of the side wall that defines the opening (for example, as illustrated, an opening closable by the illustrated door). The joist brackets 66 distribute the loading on the side wall proximate the opening through the joist tube 56 and ground pan to the ground.

Figure 10:
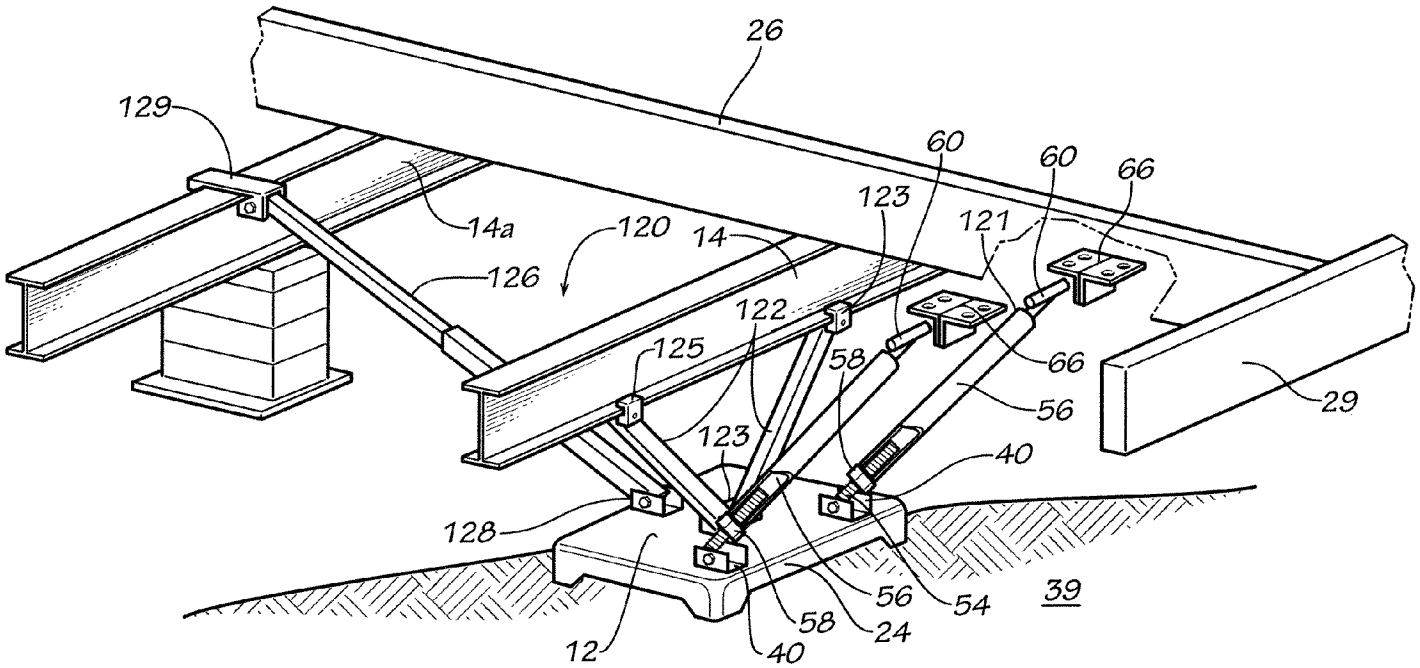
FIG. 10 illustrates in perspective view a pair of the support piers used together with a foundation system that provides lateral and longitudinal wind load resistance for the manufactured building.

FIG. 10 illustrates in perspective view a pair of the support piers 12 used together with a foundation system for a manufactured building. The illustrated foundation system generally 120 is exemplary and provides lateral and longitudinal wind load resistance for the manufactured building. The system 120 uses the ground pan 24. A pair of longitudinal braces 122 pivotably connect at respective first ends through a connector 123 to the ground pan 24 and pivotably connect at an opposing second end through a beam connector 125 to the support beam 14. A lateral brace 126 connects at a first end through a connector 128 to the ground pan 24 and connects at an opposing second end through a beam connector 129 to an adjacent support beam 14*a*. The details and structure of the foundation system 120 useful with the support pier 12 of the present invention are disclosed in U.S. Pat. Nos. 6,634,150 and 7,526,899. U.S. Pat. No. 6,634,150 discloses a foundation with a lateral brace for a manufactured building. U.S. Pat. No. 7,526,899 discloses a foundation with longitudinal braces for a manufactured building. No further discussion of these exemplary foundations is believed necessary.

Figure 11:
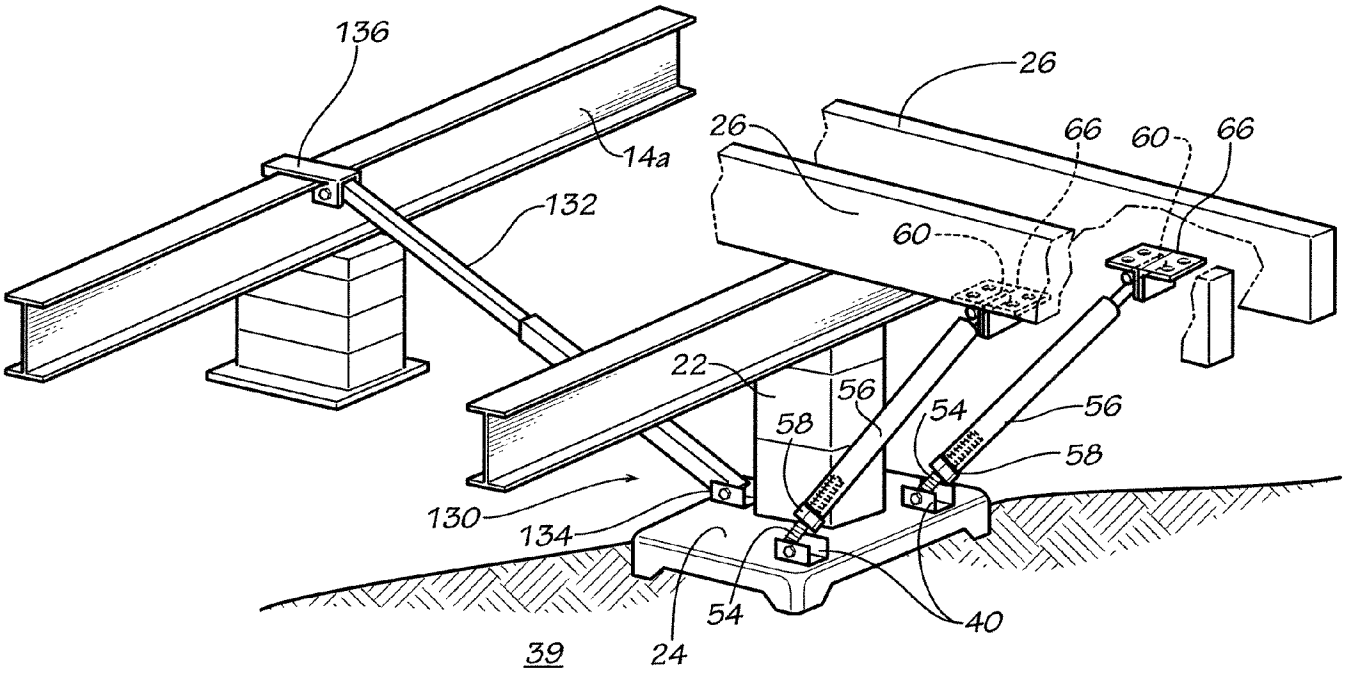
FIG. 11 illustrates in perspective view a pair of the support piers used together with a foundation system that provides lateral wind load resistance for the manufactured building.

FIG. 11 illustrates in perspective view a pair of the support piers 12 used together with a foundation system 130. The foundation system 130 uses the ground pan 24. A lateral brace 132 connects at a first end through a connector 134 to the ground pan 24 and connects at a second end through a connecter 136 to the adjacent support beam 14*a*. The block pier 22 between the support beam 14 and the ground pan 24 transfers vertical loading of the manufactured building 10 to the ground.

Figure 12:
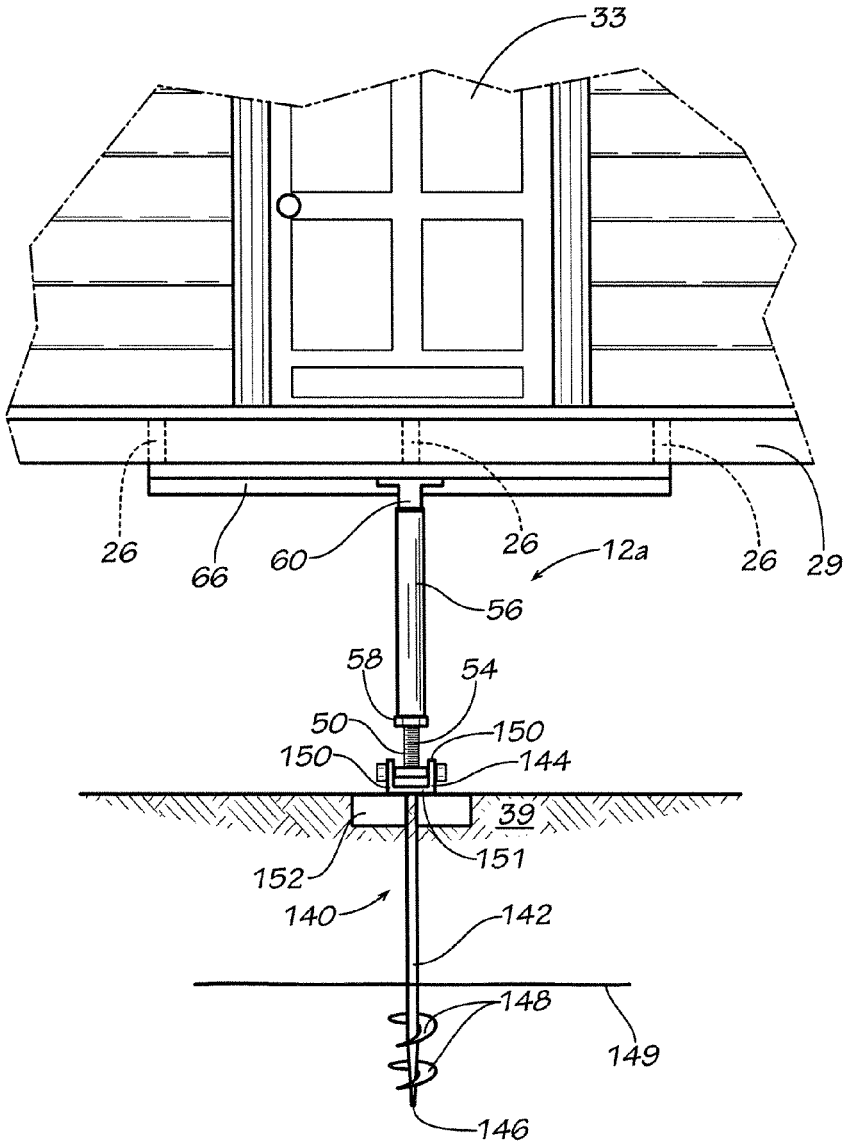
FIG. 12 illustrates in elevational view an alternate embodiment of the support pier according to the present invention using a ground anchor for supporting a lateral portion of the manufactured building.

FIG. 12 illustrates in elevational view an alternate embodiment of the support pier 12*a*. The alternate embodiment uses a ground anchor 140 for the ground member that engages the ground to support the lateral portion of the manufactured building 10. The ground anchor 140 includes a shaft 142 having a connector 144 at a first end and a distal tip 146 at an opposing end. One or more helical thread members 148 attach in spaced-apart relation to the shaft 142 proximate the distal tip 146. The shaft 142 has a length sufficient to dispose the helical flights 148 below a frost line 149 of the ground 39. The connector 144 is similar to the connector 40 discussed above. The connector 144 in the illustrated embodiment is a plate folded to define a U-shape with a base 151 and a pair of opposing upstanding side walls 150. The side walls 150 each define at least one opening aligned with the opening in the opposing side wall. The illustrated embodiment includes an anchor cap 152 (which is optional). The T-bolt 50 installs on the connector 144, and the threaded member 54 engages the nut 58. The joist tube 56 receives the T-cap 60 that bears against the joist bracket 66.

It is to be appreciated that larger diameter helix members, multiple helix members, longer length shafts, or combination can be used with the anchor pier of the present invention to achieve higher load holding capacity or for use in less dense soil or ground. The anchor pier and the cap can be made of steel, plastic, or other suitable material.

Figure 13A:
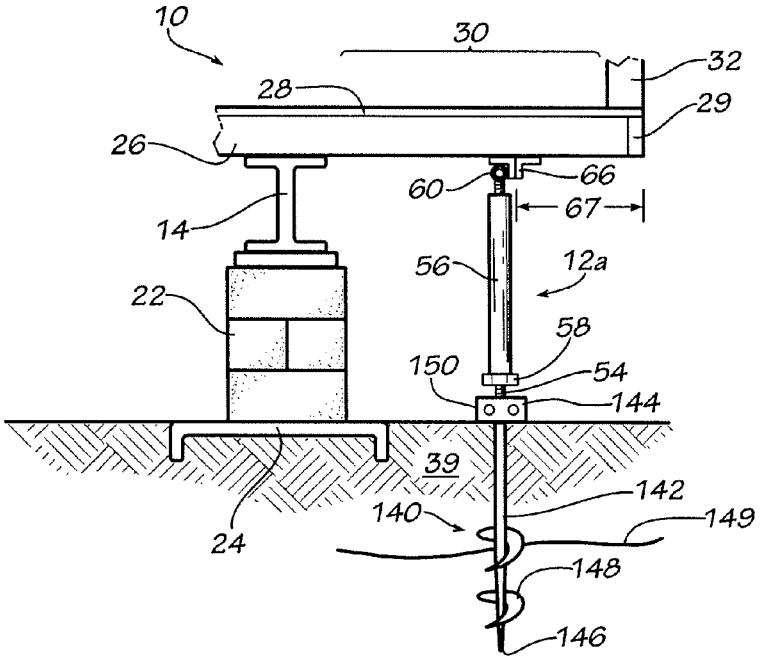
FIG. 13*a* illustrates in side elevational view a first alternate position of the support pier shown in FIG. 12 for supporting a lateral portion of the manufactured building.

FIG. 13*a* illustrates in side elevational view a first alternate position of the support pier shown in FIG. 12 for supporting a lateral portion of the manufactured building. In this embodiment, the side walls 150 of the connector 144 each define a pair of space-apart openings. The joist bracket 66 attaches to the joists 26 spaced 67 from the outside face of the rim joist 26. The ground anchor 140 installs inwardly of the side wall of the manufactured building, and further, the shaft 142 is sufficiently long to dispose the helical flights 148 below a frost line.

Figure 13B:
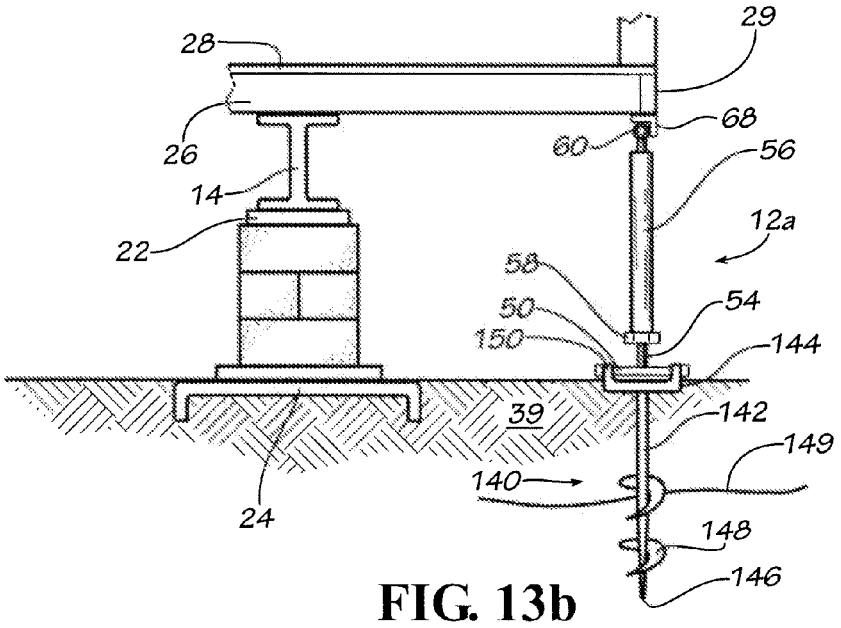
FIG. 13*b* illustrates in side elevational view a second alternate position of the support pier shown in FIG. 12 for supporting a lateral portion of the manufactured building.

FIG. 13*b* illustrates in side elevational view a second alternate position of the support pier 12*a* for supporting the lateral portion 30 of the manufactured building 10. In this position, the joist tube 56 is disposed in-line with the rim joist 29. This embodiment uses the single angle member 68 for the joist bracket 66.

Figure 14:
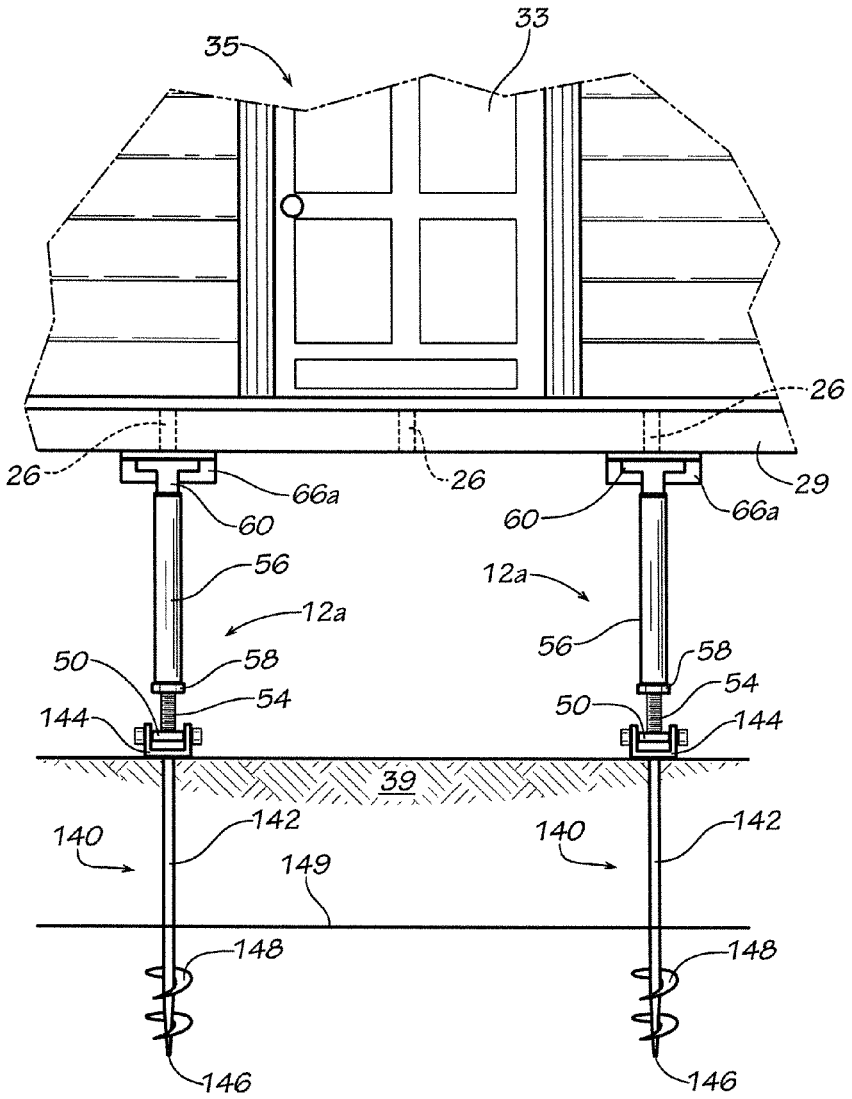
FIG. 14 illustrates in elevational view an alternate application using pair of the support piers with ground anchors for supporting the lateral portion of the manufactured building.

FIG. 14 illustrates in elevational view an alternate application that uses a pair of the support piers 12*a* with respective ground anchors 140 for supporting the lateral portion of the manufactured building 10. The support piers 12*a* are disposed in space-apart relation substantially aligned with respective opposing side edges of the side wall which define the opening 35 for the door 33. Relatively short joist brackets 66*a* may be used for distributing loading. Similarly, a plurality of the support piers 12*a* may be placed under the manufactured building for perimeter load support if required.

Figure 15:
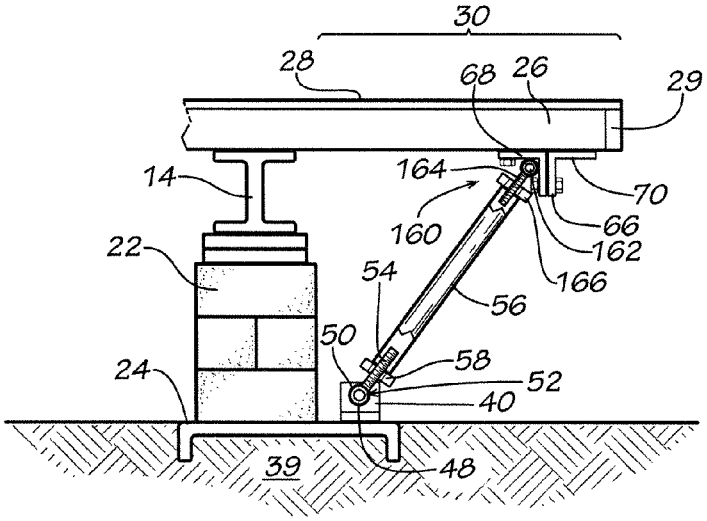
FIG. 15 illustrates in side elevational view an alternate embodiment of the support pier for supporting the lateral portion of the manufactured building.

FIG. 15 illustrates in a side elevational view an alternate embodiment of the support pier 12*b*, in which the T-cap 60 received by the joist tube 56 is replaced with an adjustable connector 160 as shown in partial cut-away. The connector 160 includes a bearing member 162 and a threaded guide member 164. The guide member 164 welds to the bearing member 162 at a perpendicular angle to a longitudinal axis of the bearing member. An adjusting member or nut 166 defines a threaded opening that engages the threaded guide member 164. The adjusting member 166 seats at the open end of the joist tube 56. The adjusting member 166 rotatable relative to the joist tube 56. With the bearing member 162 in contact with the joist bracket 66, rotating the adjusting member 166 causes the guide member 164 to move relative to the joist tube. The connector 40 discussed above connects to the ground pan 24 and engages the T-bolt 52 for connecting to the nut 58 at the lower end of the joist tube 56.

Figure 16:
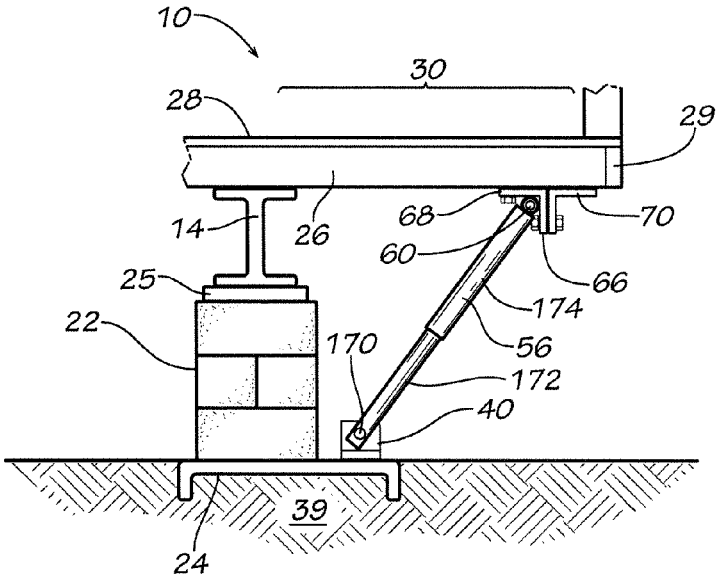
FIG. 16 illustrates in side elevational view an alternate embodiment of the support pier for supporting the lateral portion of the manufactured building.

While the embodiments discussed above provide lateral support with longitudinal movement of the joist tube 56 (and/or the adjustable connector 160), FIG. 16 illustrates in side elevational view an alternate embodiment of the support pier 12*b* for supporting the lateral portion of the manufactured building. The support pier 12*b* uses the ground member discussed above (either the ground pan 24 or the ground anchor 140) with the connector 40, 144. A first end of the joist tube 56 defines opposing openings. A threaded bolt 170 extending through the openings in the joist tube 56 pivotably connects the joist tube to the connector 40, 144. The opposing end of the joist tube 56 receives the T-cap 60 which bears against the joist bracket 66. In one embodiment, the joist tube 56 assembles from a pair of tubes 172, 174 that telescope together and are secured with fasteners at a selected length; in a second embodiment, the joist tube 56 is unitary and cut-to-length during installation.

With reference to FIGS. 1 and 2, the support pier 12 operates to support the lateral portion 30 of the manufactured building 10 proximate the opening in the side wall 32. This is accomplished by an installer attaching the U-shaped bracket 40 to the top surface of the ground pan 24 using a nut and bolt. The installer next determines the floor joist 26 that is substantially medial of the opening in the side wall 32 for which support is to be provided with an embodiment of the support pier 12 according to the present invention. An area of ground is selected for placement of the ground pan 24. The selected area is located under the beam support 14 and in-line with the determined medial joist 26. It may be necessary for the installer to remove weeds and debris in the selected area to expose firm, level undisturbed soil or controlled fill. The ground pan 24 is placed on the ground 39 centered under the beam support 14 and in-line with the medial joist 26. The ground pan 24 is firmly pressed or driven into the ground 39 so the soil surface contacts the inner surface of the top of the ground pan 24.

The threaded T-bolt 52 is placed between the walls 42 of the bracket 40. The bolt 48 extends through the opening in a first side wall 42, through the tube 50 and through the opening in the opposing side wall 42. A nut attaches to the bolt 48 and loosely tightened.

With reference to FIG. 1 and FIG. 3, the joist bracket 66 attaches to the joists 26. In the illustrated embodiment, the first angle member 68 and the second angel member 70 first connect together with the bolts 92 extending through the aligned openings 82, 90 in the backs 74, 86. Nuts 94 received on the bolts 92 rigidly connect the angle members 68, 70 together in back-to-back relation. The joist bracket 66 is disposed inwardly the predetermined distance 67 from the rim joist 29 and centered on the selected joist 26 that is substantially medial of the opening in the side wall 32. In the illustrated embodiment, the joist bracket 66 is disposed inwardly about 10 inches from an outside surface of the perimeter rim joist 29. Using a drill, pilot holes are drilled into the respective joists 26 for selected ones of the openings 76. Lag bolts 78 or other fasteners secure the joist bracket 66 to the joists 26.

Returning to FIG. 1, the joist tube 56 is pivotably raised in order to measure the length of the tube to reach the joist bracket 66. The distal end of the joist tube 56 is then cut so the length of the joist tube is 1 inch (or about) shorter than the measured length. The T-cap 60 inserts into the distal end of the joist tube 56. The assembly pivots upwardly to position the bearing member 64 against the leg 72 and back 74 of the first angle member 68. The concrete block pier 22 is then built on the ground pan 24. Wood supports 25 may be necessary between the I-beam 14 and the upper blocks in the stack of blocks 27 in the pier 22. A wrench is then used to turn the nut 58 in order to rotate the joist tube 56. Rotating the joist tube 56 on the threaded member 54 causes the joist tube to move longitudinally towards the joist bracket 66. This causes the bearing member 64 to bear against the leg 72 and back 74 of the joist bracket 66. A threaded member 54 in the illustrated embodiment has a ¾ inch diameter and length of 6 inches, which accommodates a longitudinal adjustment of about 4 inches. The nut holding the bolt 48 is then tightened firmly. The medially disposed support pier 12 supports the lateral portion 30 of the manufactured building 10, for example, proximate the opening for the door 33 in the side wall or for supporting roof load on the side wall. The joist bracket 66 distributes the loading from the side wall through the joist tube 56 and the ground pan to the ground. It is to be appreciated that the one support pier 12 medially disposed with the load-distributing joist bracket 66 replaces two conventional concrete block piers typically required to be installed on opposing sides of an opening (door or window) or structure requiring side wall support (i.e., a fireplace or chimney).

In an alternate embodiment (not illustrated), the joist tube 56 pivotably attaches to the joist bracket 66, and the T-cap 60 attaches to the opposing end of the joist tube to bear forcibly against a bracket, such as an L-shaped angle member, attached to the ground pan 24.

Yet another alternate embodiment welds the joist bracket 66 directly to the end of the joist tube 56. With the lower end of the joist tube 56 pivotably connected to the ground pan 24 through the T-bolt 52 and the connector 44, the support pier in this embodiment provides both tension and compression load resistance.

It is to be appreciated that side walls of the manufactured building 10 which are transverse to a longitudinal axis of the support beam 14 (or parallel to the spaced apart joists 26) may likewise define openings requiring support. An embodiment of the support pier 12 gainfully supports the portion of the manufactured building 10 proximate the opening. This application of the present invention may use only the first angle member 68 rather than the attached first and second angle members 68, 70 that define the joist bracket 66. The first angle member 68 secures with fasteners 72 extending through the openings 76 to a single joist 26 transverse to the support beam 14 and spaced inwardly of the rim joist 29. Alternatively, the first angle member 68 attaches to the rim joist. The joist bracket 66 thus attaches to one joist 26 rather than spanning across several spaced-apart joists 26 as depicted in FIGS. 2 and 3. The ground pan 24 is positioned on a suitable area of ground medial the opening. The joist tube 50 attaches to the bracket 40 as described above. The joist tube 56 is pivotably raised in order to measure the length of the tube to reach the joist bracket 66. The distal end of the joist tube 56 is then cut to have the joist tube about 1 inch shorter than the measured length. The T-cap 60 inserts into the distal end of the joist tube 56. The assembly pivots upwardly to position the bearing member 64 against the leg 72 and back 74 of the first angle member 68. A wrench is then used to turn the nut 58 in order to rotate the joist tube 56. Rotating the joist tube 56 on the threaded member 54 causes the joist tube to move longitudinally towards the joist bracket 66. This causes the bearing member 64 to bear against the leg 72 and back 74 of the joist bracket 66. The installed support pier 24 provides support to the portion of the manufactured building 10 proximate the opening in the transverse side wall. If the opening in the side wall is aligned with the support beam 14, a block pier 22 may be installed prior to causing the joist tube 56 to be extended into bearing contact with the joist bracket 66.

FIG. 5 illustrates an alternate embodiment in which the support pier 12 uses a poured concrete pad 96 that receives an anchor head 98 having a U-shaped head 100 and a J-member 102. The J-member 102 is embedded into the poured concrete that cures to rigidly secure the anchor head 98 to the concrete pad 96. The U-shaped head 100 includes opposed side walls 104 and base 106. The side walls 104 define aligned openings 108 for receiving the bolt 48 and T-bolt 52 for connecting to the joist tube 56, as discussed above.

With reference to FIG. 7, the support pier 12 and the joist bracket 114 support a portion of the manufactured building 10 lateral of the support beam 14, where a side wall has an opening transverse to the floor joists 26 (or parallel to the longitudinal axis of the support beam 14) of the manufactured building. A joist 26*a* substantially medial the opening is determined. The joist bracket 110 installs with fasteners extending through the openings 116 into the selected joist 26*a*. The neck portion 114 angles downwardly. The joist bracket 110 is disposed with a set-back (approximately 10 inches) from an outside face of the rim joist 29. The ground pan 24 seats below the support beam 14 and in-line with the joist 26*a*. The connector 40 attached to the ground pan 24, connects with the T-bolt 52 to the joist tube 56. The joist tube 56 is cut-to-length as discussed above. The joist tube 56 pivots upwardly to align the open end with the necked portion 114. The necked portion 114 seats in the open distal end of the joist tube 56. The joist tube 56 is moved as discussed above by rotating the nut 58 with a wrench. Rotating the nut 58 causes rotation of the joist tube 56 relative to the threaded member 54. This causes the joist tube 56 to move longitudinally towards the joist bracket 110. The open end of the joist tube 56 receives the necked portion 114. Continued movement causes the joist tube 56 to bear forcibly against the joist bracket 110. A block pier 22 may be installed as illustrated and as discussed above.

FIGS. 8-11 illustrate further applications of the support piers 12 in conjunction with foundations for manufactured buildings. FIG. 8 shows the opening in the side wall of the lateral portion 30 of the manufactured building 10 supported by the pair of support piers 12. The joist tubes 56 extend to intermediate portions of the joists between the edges of the side wall that define the opening. FIG. 9 shows the joist tubes extending at angles to the edges of the side wall that define the opening. FIGS. 10 and 11 illustrate the support piers 12 used together with foundation systems for manufactured buildings.

With reference to FIG. 12, the support pier 12*a* operates with the ground anchor 140 providing compression or downward load support to perimeter portions of the manufactured building 10. The anchor pier 140 is positioned in alignment with a medial joist 26 relative to the opening 35 or a selected joist 26 for positioning the support pier 12*a* relative to other support piers in accordance with the requirements of the manufacturer of the building. The anchor pier 140 is driven into the ground. This is accomplished with a power driver or lever for rotating the shaft 142 to drive the tip 146 into the ground with the helical flights 148. For sites susceptible to ground freezing, the helical flights 148 should be driven below the frost line 149 of the ground 39.

The joist bracket 66 attaches with fasteners to the joist 26. The T-bolt 52 attaches to the connector 144 and the threaded member 54 engages the nut 58. The joist tube 56 receives the T-cap 60 and then pivots into alignment with the joist bracket 66. A wrench is used to rotate the nut 58 and cause the joist tube 56 to move longitudinally as the nut moves on the threaded member 54. This moves the joist tube 56 into forcing contact with the joist bracket 66. The support pier 12*a* then transfers loading from the manufactured building to the ground. An embodiment in which the joist bracket 66 is welded to the joist tube 56 resists compression and tension load forces.

FIG. 13*a* illustrates the support pier 12*a* spaced inwardly a predetermined distance from the exterior face of the rim joist 29. FIG. 13*b* illustrates the support pier 12*a* aligned with the rim joist 29.

FIG. 14 illustrates a pair of the support piers 12*a* with the ground anchors 140 for supporting the lateral portion of the manufactured building. The support piers 12*a* are disposed in space-apart relation substantially aligned with respective opposing side edges of side wall which define the opening 35 for the door 33. Similarly, a plurality of the support piers 12*a* may be placed under the manufactured building for load support if required.

The alternate embodiment of the support pier 12*b* illustrated in FIG. 15 permits longitudinal bearing adjustment at both the lower and upper ends of the joist tube 56. As discussed above with respect to FIG. 1, the joist tube 56 pivotably connects with the T-bolt 52 and nut 58 to the connector 44 on the ground pan 24. Rather than receive the T-cap 60, the upper end of the joist tube receives the connector 160. The joist tube 56 pivots to dispose the bearing member 162 proximate the joist bracket 66. The nut 58 is rotated with a wrench to move the joist tube 56 towards the joist bracket 66 and push the bearing member 162 into contact with the joist bracket. In this embodiment, additional bearing force may be applied to push the bearing member into bearing contact with the joist bracket 66. This is accomplished by using the wrench to turn the adjusting member 166 relative to the joist tube 56. With the bearing member 162 in contact with the joist bracket 66, rotating the adjusting member 166 causes the guide member 164 to move longitudinally relative to the adjusting member 166 and joist tube 56. The threaded guide member 164 moves to drive the bearing member 162 forcibly into contact with the joist bracket 66.

While the embodiments discussed above provide lateral support with longitudinal movement of the joist tube 56 (and/or the adjustable connector 160), FIG. 16 illustrates in side elevational view the alternate embodiment of the support pier 12*b* for supporting the lateral portion of the manufactured building. In use, the ground pan 24 with connector 40 or the ground anchor 140 is installed as discussed above. The joist bracket 66 is also installed as discussed above. The joist tube 56 pivotably connects to the connector with a bolt that extends through the aligned openings in the side wall of the connector and the openings in the lower end of the joist tube 56. A nut secures the bolt to the connector 40, 140. In a first embodiment, the joist tube 56 assembles with the telescoping tubes 172, 174. For example, the tube 172 has a 1 and ¼ inch diameter and the tube 174 has a 1 and ½ inch diameter. The joist tube 56 pivots to orient towards the joist bracket 66. The tubes 172, 174 telescope apart to extend the free distal end into contact with the joist bracket. The free end may receive the T-cap 60 for bearing contact with the joist bracket 66. When positioned, the telescoped tubes 172, 174 are secured together with fasteners.

In the second embodiment, the distance between the connection of the joist tube to the connector and the joist bracket is measured, and a distal portion cut-off. The joist tube receives the T-cap 60 or other bearing member. The manufactured building is raised slightly (for example, using a screw jack or inflatable jack or the like). The joist tube 56 is pivotably moved to be diagonal between the ground member and the joist bracket 66. The jack is lowered to move the manufactured building into bearing contact with the T-cap 60 or other bearing member.

The present invention accordingly provides the support pier for the lateral portion of a manufactured building proximate a side wall that has an opening, that experiences increased structural loading (such as from a chimney or fireplace) or the manufactured building is located at a site that experiences increased roof loading (such as snow), with the joist tube attached to a ground pan at one end and an opposing end that bears against the joist bracket proximate the lateral portion of the building requiring pier support. The ground support member disposed on the ground laterally and inwardly of the outside face of the side wall 32 of the manufactured building, positions the ground support away from ground most susceptible to water saturation and thus less susceptible to ground heave or movement caused by freezing and thawing weather conditions. The embodiment using the ground anchor as the ground support member aligned with the side wall of the manufactured building disposes the helical flights below the frost line. While this invention has been described in detail with particular references to illustrated embodiments thereof, it should be understood that many modifications, additions and deletions, in additions to those expressly recited, may be made thereto without departure from the spirit and scope of the invention.

What is claimed is:

1. A support apparatus for supporting a lateral portion of a manufactured building having a support beam extending longitudinally in a first direction and having a plurality of spaced-apart floor joists disposed transverse to the support beam extending in a second direction to a lateral edge of the manufactured building, comprising:

a ground member for being received on a ground surface beneath a support beam of a manufactured building having a portion lateral of the support beam;

a joist bracket for being attached to at least one joist proximate the lateral edge in the lateral portion of the manufactured building;

a joist tube for being disposed transverse to the support beam and extending in the second direction and a first end bearing against the ground member;

a connector for pivotably connecting the first end of the joist tube to the ground member;

a cap member disposed at a second end of the joist tube for bearing against the joist bracket; and a mover assembly for being operatively engaged to the joist tube for moving the joist tube longitudinally from a first position to a second position, whereby the joist tube being moved longitudinally to the second position by operating the mover assembly bears against the joist bracket and the ground member for transferring a load from the lateral portion of the manufactured building to the ground and thereby supporting the lateral portion of the manufactured building.

2. The support apparatus as recited in claim 1, wherein the cap member comprises:

a base member that matingly engages the joist tube at the second end; and a bearing member rigidly attached to the base member for bearing against the joist bracket.

3. The support apparatus as recited in claim 2, wherein the bearing member comprises a rod having a longitudinal axis transverse to a longitudinal axis of the base member.

4. The support apparatus as recited in claim 2, wherein the second end of the joist tube is open and the base member is received therein.

5. The support apparatus as recited in claim 1, wherein:

the joist tube comprises an open ended elongated tube; and the mover assembly comprises:

a rotation member disposed at the first end of the joist tube and defining a threaded opening coaxial with the tube; and a threaded connector for theadably connecting to the rotation member, the threaded connector pivotably connected to the ground member.

6. The support apparatus as recited in claim 5, further comprising:

a U-shaped bracket having opposing legs and a base that rigidly connects to the ground member and the legs defining aligned opposing openings;

an axle mounted between the opposing legs for pivotable positioning thereof relative to the ground member; and the threaded connector attached to the axle and extending therefrom.

7. The support apparatus as recited in claim 6, wherein the axle comprises a threaded bolt having a nut for securing the bolt in the opposing openings of the U-shaped bracket.

8. The support apparatus as recited in claim 1, wherein the joist bracket comprises an angle member that defines a plurality of openings for receiving fasteners therethrough for attaching the joist bracket to a joist of the manufactured building.

9. The support member as recited in claim 1, wherein the joist bracket comprises a first angle member and a second angle member, each having a leg and a back, the backs each defining at least a pair of openings for receiving fasteners so that the first angle member and the second angle member join together back-to-back therewith, the leg members each defining spaced-apart plurality of openings for receiving second fasteners for attaching the joist bracket to at least one joist of the manufactured building.

10. The support member as recited in claim 1, further comprising a plurality of blocks stacked on the ground member to support the support beam.

11. The support member as recited in claim 1, wherein the ground member comprises a ground pan having a planar base and at least a pair of opposing sides extending in a first direction substantially perpendicular to the base for being embedded in the ground.

12. The support member as recited in claim 1, wherein the ground member comprises a ground anchor having an elongated shaft with at least one helical flight disposed proximate a first end and the connector attached to an opposing end of the elongated shaft for pivotably engaging the joist tube.

13. The support apparatus as recited in claim 5, wherein the connector further comprises:

a U-shaped bracket having opposing legs and a base that rigidly connects to the elongated shaft and the legs define aligned opposing openings;

a tube mounted between the opposing legs for pivotable positioning thereof relative to the ground member; and the threaded connector attached to the tube and extending therefrom for connecting to the rotation member.

14. The support apparatus as recited in claim 13, wherein the tube comprises a threaded bolt having a nut for securing the bolt in the opposing openings of the U-shaped bracket.

15. The support apparatus as recited in claim 1, further comprising a second mover assembly operatively disposed between the second end of the joist tube and the cap member for moving the cap member from a first position to a second position bearing forcibly against the joist bracket.

16. The support apparatus as recited in claim 15, wherein the second mover assembly comprises:

a rotation member disposed between the joist tube and the cap member and defining a threaded opening coaxial with the joist tube; and a threaded member for theadably engaging the rotation member, the threaded member connected to the cap member.

17. A method for supporting a lateral portion of a manufactured building having a support beam extending longitudinally in a first direction and having a plurality of spaced-apart floor joists disposed transverse to the support beam extending in a second direction to a lateral edge of the manufactured building, comprising the steps of:

(a) positioning a ground member on a ground surface below a support beam of a manufactured building;

(b) attaching a joist bracket to at least one joist proximate the lateral edge in the lateral portion of the manufactured building; and (c) disposing a joist tube transverse to the support beam and extending in the second direction with a first end in bearing contact with the ground member and a second end bearing on the joist bracket;

(d) longitudinally moving the joist tube from a first position with the second end of the joist tube spaced from the joist bracket to a second position bearing against the joist bracket, whereby the joist tube bears forcibly against the joist bracket and the ground member for transferring a load from the lateral portion of the manufactured building to the ground and thereby support the lateral portion of the manufactured building.

18. The method as recited in claim 17, wherein longitudinally moving the joist tube comprises rotating a nut on a threaded member pivotably attached to a connector of the ground member, the nut contacting the joist tube which moves in response to rotating the nut.

19. The method as recited in claim 17, further comprising the step of inserting a cap member in an open distal end of the joist tube for contactingly bearing against the joist bracket.

20. The method as recited in claim 19, further comprising the step of assembling the cap member by rigidly attaching a bearing member to a base member that is received in the distal end of the joist tube.

21. The method as recited in claim 17, further comprising assembling the joist bracket by connecting a first angle member and a second angle member together, each angle member having a leg and a back, the backs each defining at least a pair of openings for receiving fasteners so that the first angle member and the second angle member join together back-to-back therewith, the leg members each defining spaced-apart plurality of openings for receiving second fasteners for attaching the joist bracket to at least one joist of the manufactured building.

22. The method as recited in claim 17, wherein the ground member is disposed under a support beam of the manufactured building aligned with a floor joist that is substantially medial an opening in a side wall to distribute the loading of the building to the outside edges of the opening.

23. The method as recited in claim 17, wherein the joist bracket attaches to the floor joist spaced inwardly of an outward side of a perimeter rim joist.

24. The method as recited in claim 19, further comprising the step of moving the cap member at one end of the joist tube from a first position to a second position forcibly bearing against the joist bracket.

25. The method as recited in claim 17, wherein step (a) positioning the ground member comprises the ground member comprising ground pan with at least two opposing perimeter walls extending substantially perpendicularly in a first direction which perimeter walls are pushed into the ground.

26. The method as recited in claim 17, wherein step (a) positioning the ground member comprises rotating a shaft having at least one helical flight into the ground.

27. The support apparatus as recited in claim 1, wherein:

the joist tube further comprises a rotation member at a first end thereof; and the connector comprises:

a U-shaped bracket having opposing legs and a base that rigidly connects to the elongated shaft and the legs define aligned opposing openings:

a tube mounted between the opposing legs for pivotable positioning thereof relative to the ground member; and a threaded connector attached to the tube and extending therefrom for threadably connecting to the rotation member for longitudinal movement of the joist tube between the first position and the second position for bearing against the joist bracket.

28. The support apparatus as recited in claim 1, wherein the mover assembly comprises:

a rotation member disposed between the joist tube and the cap member and defining a threaded opening coaxial with the joist tube; and a threaded member for theadably engaging the rotation member, the threaded member connected to the cap member.

29. The support apparatus as recited in claim 1, wherein the joist bracket comprises a plate having a base portion defining a plurality of openings and a neck portion extending at an angle from the base portion, the neck portion for being received in the second end of the joist tube, whereby fasteners being extended through the openings, secures the plate to the joist.

30. A support apparatus for supporting a lateral portion of a manufactured building having a support beam extending longitudinally in a first direction and having a plurality of spaced-apart floor joists disposed transverse to the support beam extending in a second direction to a lateral edge of the manufactured building, comprising:

a ground member for being received on a ground surface beneath a support beam of a manufactured building having a portion lateral of the support beam;

a joist bracket for being attached to at least one joist proximate the lateral edge in the lateral portion of the manufactured building, the joist bracket comprising a first angle member and a second angle member, each of the first and second angle members having a leg and a back, the backs each defining at least a pair of openings for receiving fasteners so that the first angle member and the second angle member join together back-to-back therewith, the leg members each defining spaced-apart plurality of openings for receiving second fasteners for attaching the joist bracket to at least one joist of the manufactured building;

a joist tube for being disposed transverse to the support beam and extending in the second direction and a first end bearing against the ground member and a second end bearing on the joist bracket; and a mover assembly for being operatively engaged to the joist tube for moving the joist tube longitudinally from a first position to a second position, whereby the joist tube being moved longitudinally to the second position by operating the mover assembly bears against the joist bracket and the ground member for transferring a load from the lateral portion of the manufactured building to the ground and thereby supporting the lateral portion of the manufactured building.

31. The support apparatus as recited in claim 30, further comprising:

a connector for pivotably connecting the first end of the joist tube to the ground member; and a cap member disposed at the second end of the joist tube for bearing against the joist bracket.

* * * * *